US005603450A

United States Patent [19]

Whitnell

[11] Patent Number: 5,603,450

[45] Date of Patent: Feb. 18, 1997

[54] COVERED CARTON

[75] Inventor: Simon Whitnell, Exton, Pa.

[73] Assignee: Dopaco, Inc., Downingtown, Pa.

[21] Appl. No.: 555,049

[22] Filed: Nov. 8, 1995

[51] Int. Cl.[6] ..... B65D 5/20

[52] U.S. Cl. ..... 229/148; 229/113; 229/160.2

[58] Field of Search ..... 229/113, 148, 229/160.2; 206/815

[56] References Cited

U.S. PATENT DOCUMENTS

| | | | |
|---|---|---|---|
| 2,072,753 | 3/1937 | Ikeda et al. | 229/148 |
| 2,393,277 | 1/1946 | Beardsell | 229/160.2 |
| 2,839,236 | 6/1958 | Dunning | 229/148 |
| 4,042,166 | 8/1977 | Selin et al. | 229/148 |
| 4,339,068 | 7/1982 | Brauner | 229/113 |
| 4,516,718 | 5/1985 | Forbes, Jr. | 229/148 |
| 4,930,681 | 6/1990 | Fultz et al. | 229/148 |
| 5,044,549 | 9/1991 | Beales | 229/148 |
| 5,118,033 | 6/1992 | Kula | 229/148 |
| 5,221,040 | 6/1993 | Sorenson . | |
| 5,226,587 | 7/1993 | Eisman et al. | 229/148 |

FOREIGN PATENT DOCUMENTS

| | | |
|---|---|---|
| 752831 | 7/1956 | United Kingdom . |
| 789928 | 1/1958 | United Kingdom . |

*Primary Examiner*—Gary E. Elkins

*Attorney, Agent, or Firm*—Dennison, Meserole, Pollack & Scheiner

[57] ABSTRACT

A fast food carton including a tray with peripheral walls integral with a bottom panel and individually foldable relative thereto between a first position substantial coplanar therewith and a second folded position forming a peripheral wall thereabout, and a lid integral with one of the tray walls and selectively foldable to cover the tray with the tray walls retained in the folded position within the lid. The carton further includes a lock assembly having a tongue integral with the tray front wall and outward projectable through a slot formed in the lid, the lid having openings defined therein for facilitating manual manipulation of the lock assembly for release.

16 Claims, 4 Drawing Sheets

Fig. 1
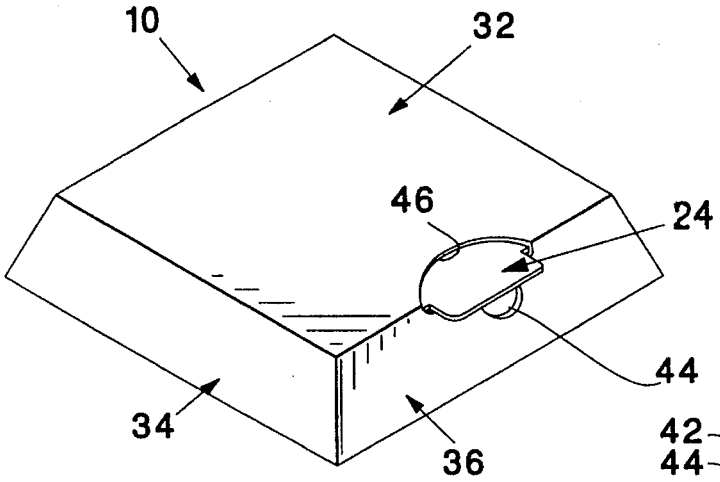
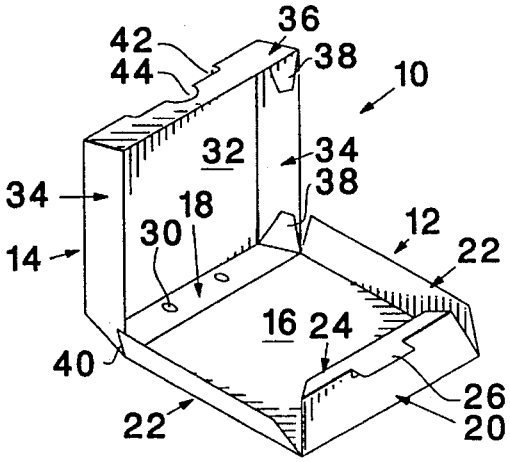
Fig. 2
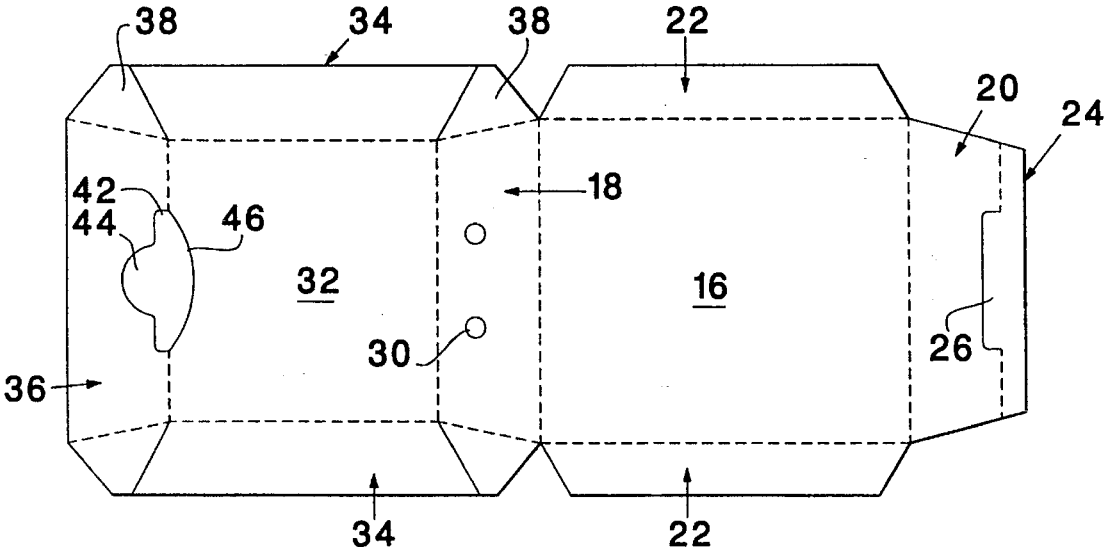
Fig. 3

Fig. 4
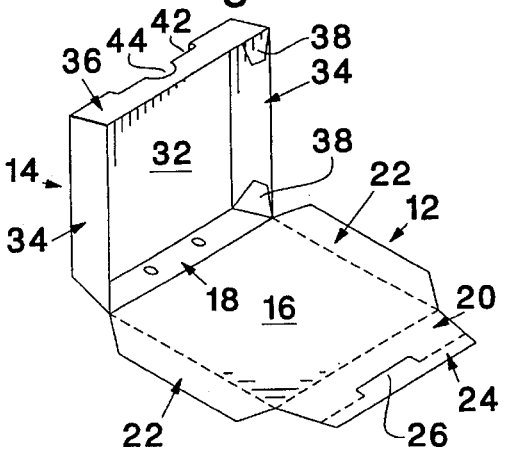
Fig. 6
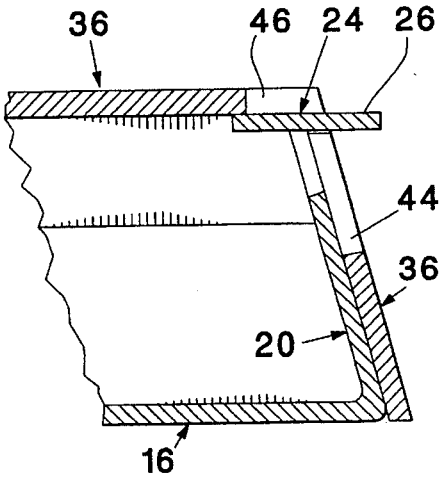
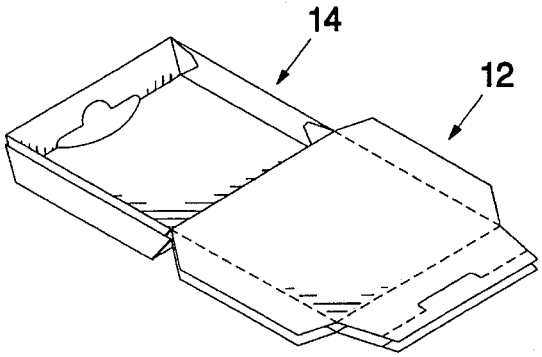
Fig. 5
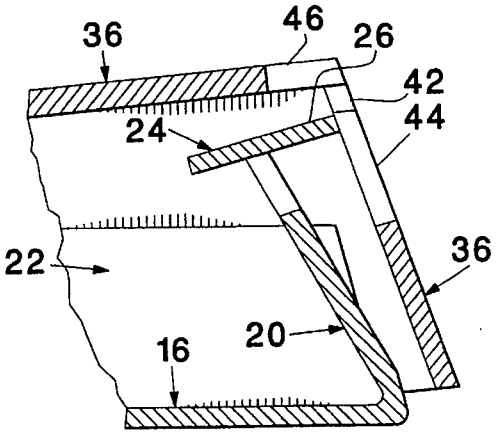
Fig. 7

Fig. 8
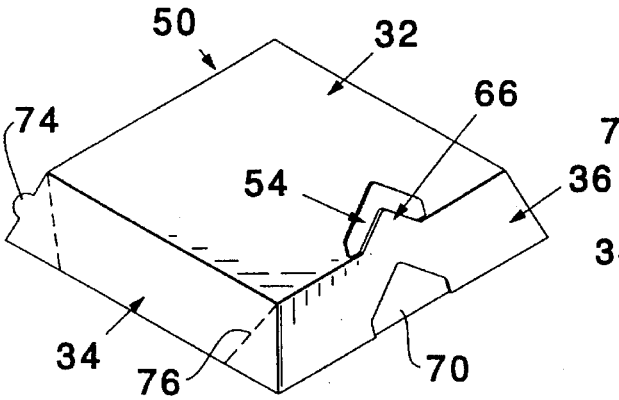
Fig. 9
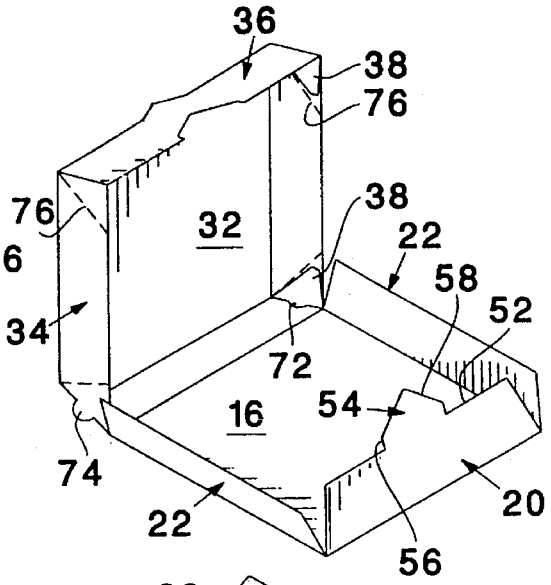
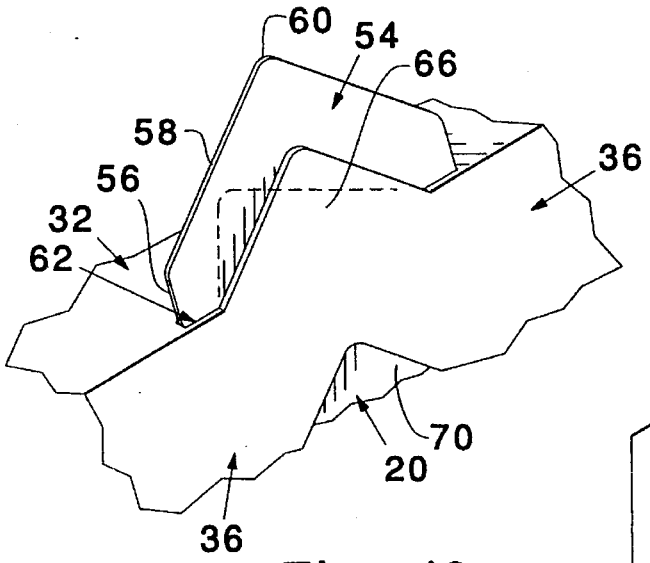
Fig. 10
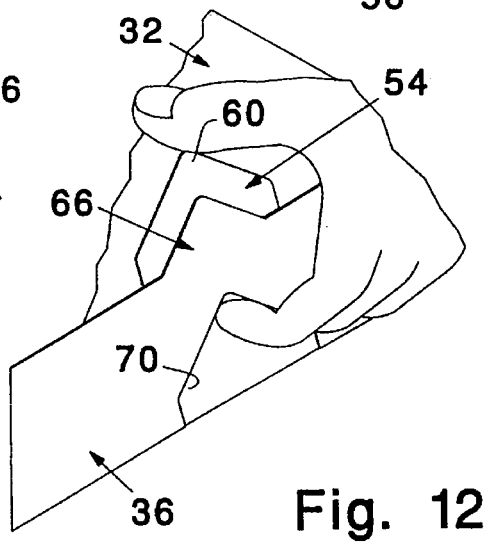
Fig. 12
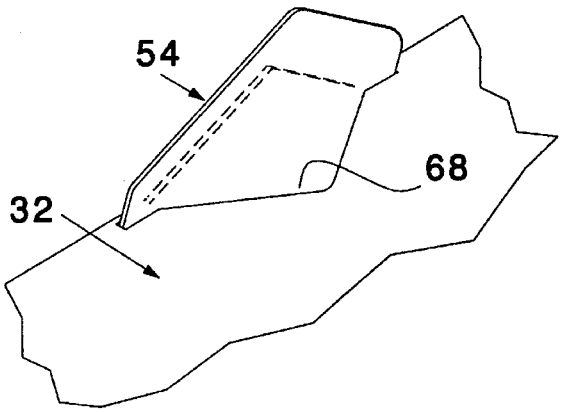
Fig. 11

COVERED CARTON

BACKGROUND OF THE INVENTION

Folded paperboard cartons have long been used as inexpensive biodegradable containers for fast food for example, hamburgers, pizza, and the like.

Such containers frequently comprise a tray and a lid integrally formed therewith from a unitary blank, both the tray and lid having peripheral corner-joined walls with the lid walls overlying the tray walls in the closed carton. The provision of fixed upstanding walls on the conventional tray of such cartons has conventionally been considered necessary to ensure sufficient strength and stability. However, such tray walls tend, depending upon the foodstuff, to restrict access to the tray, both when introducing the foodstuff and particularly in those instances where the consumer wishes to use the tray in the manner of a plate or dish from which the foodstuff is directly consumed. For example, pizza is most easily consumed from a flat dish or platter as opposed to a walled bowl-type container. Also, the conventional wall-enclosed tray forms corners in which foodstuff can be trapped.

Nevertheless, as the conventional folded paperboard carton has inherent advantages of being economically feasible for a disposable item, biodegradable, and the like, the lack of particular or desirable features is frequently considered a necessary compromise.

As a further example, known fast food cartons frequently utilize elaborate latching or locking mechanisms to ensure a positive securing of the closed cover. Such mechanisms can be both difficult to engage and difficult to disengage, and frequently lead to destruction of the mechanism when opened by a consumer, thereby precluding a proper reclosing of the carton.

SUMMARY OF THE INVENTION

The carton of the present invention differs from the conventional fast food container in providing a tray or tray portion wherein the walls thereof are coplanar or substantially coplanar with the tray bottom panel both as the food is introduced thereto and as the food is removed or directly consumed therefrom with the tray acting in the manner of a food platter.

The tray walls, including the front wall and both side wall, are not end joined as in the conventional fast food tray. Rather, in the closed carton, these walls are individually upwardly turned to confine the foodstuff received centrally thereof and engage entirely within the corresponding walls of the lid or cover. The tray walls outwardly bias against the inner surfaces of the lid walls with the lid walls extending the full height of the tray walls to directly engage a countertop or the like and provide a substantial degree of rigidity to the closed carton notwithstanding the "free" nature of the tray walls.

The lid walls are end joined by glue flaps in a substantial conventional manner. The elimination of such glue flaps for the tray walls, in addition to providing the advantages of a "flat" tray during loading and removal of the foodstuff, also reduces material and manufacturing costs. As a further step in improving the economy of production, and as possibly best appreciated from viewing the blank from which the carton is constructed, the glue flaps for the lid walls are of a greater size than actually required for structure stability and are formed so as to maintain waste material at a minimum and at the same time facilitate the application of the glue and the maintaining of the glue flaps until the glue has properly set.

A further object of the invention is to provide an effective releasable lock mechanism which automatically engages upon a closing of the lid, and which, while requiring specific manual release can be released by a single hand. The lock mechanism in one form includes a forwardly directed tongue on the tray front wall at the upper edge thereof which, through the inherent outward bias of the tray front wall, snap locks into a corresponding slot at the upper portion of the lid front wall upon alignment therewith. A semi-circular recess is defined in the lid front wall centrally of and immediately below the slot to facilitate engagement of a finger with the forwardly projecting tongue for a rearward release thereof. Similarly, the lid top panel has an arc shaped opening coextensive with the slot and extending rearwardly into the lid to allow for a manual rearward pushing of the tongue for a complete release thereof from the slot. Upon a continuation of this rearward movement, the lid itself is engaged and lifted away from the tray.

In a second embodiment, the lock mechanism comprises a tongue extending coplanar from the tray front wall centrally along the upper edge thereof and engagable through a corresponding slot defined at the juncture between the top panel of the lid and the front wall of the lid for a frictional retention of the engaged tongue. A tapered recess is provided in the top panel communicating with and immediately inward of the tongue-receiving slot for a guidance of the tongue into the slot. In order to facilitate release of the tongue, a finger recess is provided in the lid front wall centrally along the lower edge portion thereof and aligned with the tongue-receiving slot whereby, with a finger engaged within the recess and a second finger with the upper edge of the projecting tongue, a downward force can be applied against the tongue for release thereof from the receiving slot.

Other details and features of the invention will become apparent from the more specific description of the invention following hereinafter.

BRIEF DESCRIPTION OF THE DRAWINGS

FIG. 1 is a top perspective view of the closed and locked carton of the invention;

FIG. 2 is a perspective view of the carton with the lid open and the tray walls partially upturned;

FIG. 3 is a plan view of the blank from which the carton is formed;

FIG. 4 is a perspective view with the tray walls positioned coplanar with the bottom panel and in the preferred position thereof prior to introduction of the food or as a serving platter from which the food is consumed;

FIG. 5 schematically illustrates the manner in which the open cartons can be stacked for shipping and storage with the lids nested within each other;

FIG. 6 is an enlarged cross-sectional detail through the closed lock mechanism;

FIG. 7 is a similar cross-sectional view with the lock mechanism disengaged and the lid partially elevated relative to the tray;

FIG. 8 is a top and front perspective view of a modified form of carton;

FIG. 9 is a perspective view of the carton of FIG. 8 with the lid pivoted open and the tray walls slightly spread;

FIG. 10 is an enlarged perspective detail of the modified lock mechanism of the carton of FIG. 8;

FIG. 11 is a perspective detail taken from the rear of FIG. 10;

FIG. 12 is a perspective detail illustrating the preferred manner of releasing the lock mechanism;

DESCRIPTION OF PREFERRED EMBODIMENTS

Figure 13:
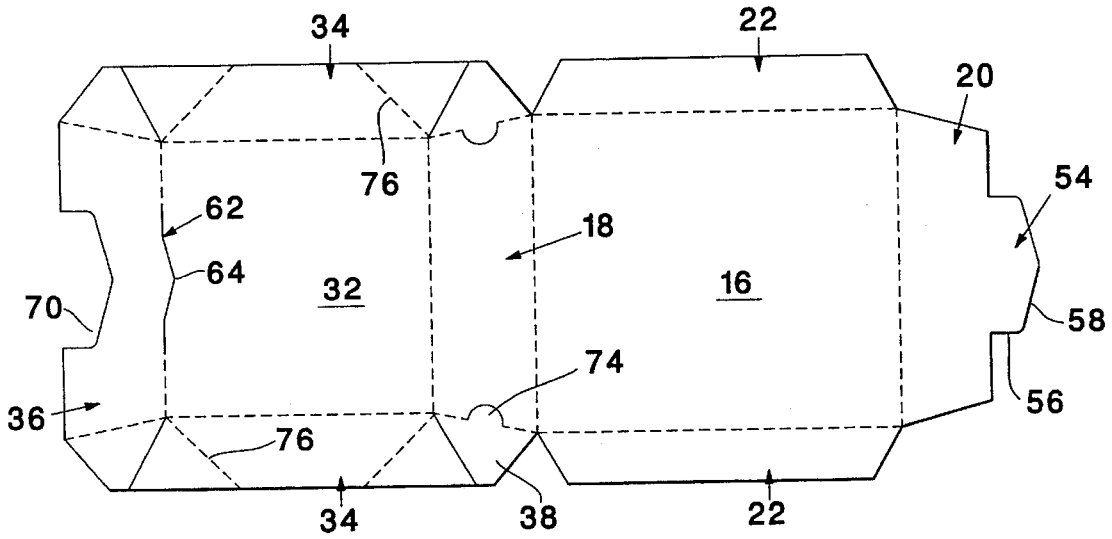
FIG. 13 is a plan view of the blank from which the carton of FIG. 8 is formed.
Figure 14:
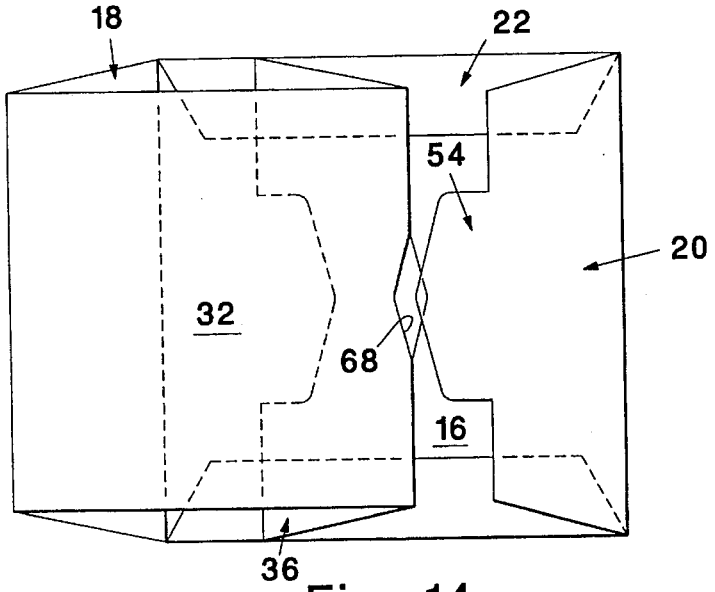
FIG. 14 is a top plan view of the FIG. 8 carton folded for compact storage and shipment.

Referring now more specifically to the drawings, and in particular FIGS. 1–7, the fast food carton or container 10 illustrated therein includes a tray 12 and a lid 14 integral therewith. While not limited thereto, the carton preferably have four sides and is rectangular in plan, as illustrated. The closed carton, noting FIG. 1 in particular, will have the configuration of a flat or truncated pyramid.

The tray 12 includes a flat bottom panel 16 with a periphery defined by four edges, each having a wall with an inner edge coextensive therewith and integrally joined thereto along fold lines defined at the bottom panel edges. The tray walls include a rear wall 18 an opposed forward wall 20 and a pair of opposed side or intermediate walls 22. The opposed side walls 22 are of equal height, as are the rear and forward walls 18 and 20. The rear and forward walls 18 and 20 are of a slightly greater height than the opposed side walls 22 with the forward wall 20 having an integral inwardly or rearwardly folded full length flap or flange 24 along the upper edge thereof. The flange 24 in turn includes a coplanar forwardly extending locking tongue 26 defined from the upper edge portion of the forward wall 20 and upwardly separated therefrom in conjunction with the inward folding of the upper edge flange 24. The aperture 28 defined in the forward tray wall 20 by the removal of the tongue 26 therefrom provides a desirable air vent for allowing steam to escape and minimize moisture damage. This is particularly desirable in such foods as pizza. Similarly, air venting holes 30 can be provided through the back wall 18.

The opposed ends of the side or intermediate walls 22 are free, that is not secured to adjacent ends of adjacent walls and are bevelled or inwardly and upwardly inclined relative to each other. The opposed ends of the front wall 20 are similarly free of the opposed ends of the adjacent side walls 22 and inclined inwardly toward each other upward from the bottom panel 16.

The lid 14 includes a top panel 32 having a periphery defined by linear edges equal in number to the linear edges of the bottom panel 16, in the illustrated example four edges to define a rectangular configuration conforming to that of the tray. The tray back or rear wall 18 has the upper or outer edge thereof integrally joined to the corresponding edge of the top panel 32. Laterally opposed lid side or intermediate walls 34 are similarly integrally joined along inner edges thereof to the opposed side edges of the top panel 32. The lid is completed by a front wall 36 integrally joined along a longitudinal inner edge thereof to the front edge of the lid panel 32.

The walls 18, 34 and 36 are end joined by appropriate glue flaps 38 to define a fixed peripheral wall structure with the walls flaring slightly outward relative to each other so as to, in the closed position of FIG. 1, define a stable, wide base, and generally pyramidal configuration with a flat top formed by the top panel 32.

The lid walls 34 and 36 are of equal height with the rear wall 18 and the tray forward wall 20, thereby completely overlying the tray and extending to a common support plane. The forward wall 20, and particularly the inwardly turned upper edge flange 24 thereof, seats against the undersurface of the top panel 32 for enhanced rigidity at the forward latched portion of the closed carton. Additional rigidity is provided at the rear of the carton in that the beveled rear ends 40 of the tray side walls 22 are at the same angle as defined by the rear wall 18 in the closed carton to lie directly against the inner surface thereof for stabilization of the rear wall. The angles of the remaining free tray wall ends are such as to, upon an upward and inward folding of these walls, conform the folded positions of these walls to the flaring configuration of the corresponding lid walls immediately outward thereof in the closed carton.

The lock mechanism or assembly, in addition to the tongue 26 on the tray 12, includes a tongue-receiving slot 42 defined centrally along the front lid wall 36 immediately below the upper edge thereof and aligned with the tongue 26 for a reception of the tongue 26 through the slot 42 upon a full closing of the lid 14 over the tray 12, as seen in FIGS. 1 and 6.

In order to facilitate the release of the locking tongue 26, particularly as the lid walls, for purposes of rigidity and appearance, extend the full height of the closed carton, a pair of release or access openings are provided, including a semi-circular opening 44 centrally of the slot 42 and extending into the upper portion of the lid front wall 36. A second wider arc-shaped opening 46, of a length equal to that of the slot 42, extends inwardly from the slot into the lid top panel 32. The openings 44 and 46 allow one to engage a finger against the projecting tongue 26 and inwardly move the tongue relative to the lid front wall 36 with the finger passing through the opening 44 and into the top panel 46 forcing the tongue rearwardly away from the lid front wall 36, after which the lid, with the finger engaging the inner arc of the top panel opening 46, merely freely upwardly pivoting away from the tray 12. Thus, a simple one-handed motion is all that is required to release the positive lock and open the lid.

In use, the cartons 10 will be shipped from the manufacture to the fast food outlet in compact stacks, noting FIG. 5, wherein the preformed lids 14 are nested, as allowed by the tapering walls, and the trays 12 with the unfolded coplanar walls, layered one upon another.

When a pizza or like foodstuff is to be put into the carton, the coplanar orientation of the tray walls allows direct introduction of the pizza on the tray bottom wall without difficulty or the necessity of "dropping" the pizza within confining walls. After the pizza is deposited, the forward and side walls of the tray are easily upwardly folded, the flange 24 inwardly folded to project the tongue 26, and the lid closed thereover. The natural tendency for the tray forward wall 20 and side walls 22 to unfold will outwardly bias these walls against the corresponding walls of the lid for snug engagement therewith, and more importantly, for an automatic projection of the locking tongue 26 through the slot 42 in the forward lid wall 36. Simultaneously with engagement of the tongue 26 through the slot, the lid walls will move to a position substantially coplanar with the bottom panel of the tray, and thus fully enclose the tray and provide for direct lid support from the table or counter upon which the carton is placed. So mounted, the lid can only be released by manual pressure on the tongue. This is effected by merely placing one finger against the outer edge of the tongue and inwardly forcing the tongue, with the forward tray wall 20 rearwardly pivoting about the lower edge thereof integral with the forward edge of the tray bottom panel, to move the tongue sufficiently inward of the lid slot 42 to allow for an upward swinging of the lid. As the lid slot 42 rather closely receives the tongue 26, only a slight upward movement of the lid relative to the tray is necessary to retain the tongue out of engagement and the lock assembly released. FIG. 7 illustrates the lock assembly either immediately prior to engagement or immediately after disengagement and a slight raising of the lid. In both cases, the tendency for the tray front wall 20 to return to its position coplanar with the bottom panel 16, biases the forward edge of the tongue 26 against the inner surface of the lid front wall 36.

Upon a complete opening of the lid, as in FIG. 2, the tray walls 20 and 22 will tend to fold outwardly and, with a little manual encouragement, again assume a position generally parallel to the tray base panel 16, thereby providing a flat surface from which the pizza or the like can be easily removed or from which the pizza can be directly consumed without obstruction from the tray walls.

FIG. 3 is of particular interest in illustrating the cut blank, with the various fold lines defined thereon, from which the carton 10 is formed. The various components of the carton are referred to by like reference numerals on the blank, and the fold lines formed as dash lines. The simplicity of the blank, requiring minimal material, only four glue flaps, and little waste, enhances the novelty of the invention.

While not specifically referred to above, it is to be appreciated that the rear wall 18 is a hinge wall with the integral fold line between this rear wall and the rear peripheral edge of the tray bottom panel 16 defining the hinge about which the lid 14 pivots relative to the tray 12.

Turning now to the embodiment of FIG. 8–14, the fast food carton 50 illustrated therein is basically the same as the carton 10, differing in some particulars, principally the lock assembly, which are themselves considered of particular significance. For purposes of explanation, the panels and walls of the carton 50 have been referred to by the same reference numerals as used with regard to the carton 10.

Turning specifically to the lock assembly of carton 50, the forward tray wall 20 is imperforate and includes a free outer edge 52 from which a centrally positioned coplanar tongue 54 upwardly projects. The tongue 54, at the maximum length thereof along the top wall edge 52, includes opposed parallel lower edge portions 56 extending at right angles to the upper edge 52 of the front wall 20. Above or outward of the parallel edge portions 56, second upwardly or outwardly converging edge portions 58 converge to define a leading upwardly directed apex 60 forming a generally arrowhead configuration.

In order to receive and secure the tongue 54 in the closed position of the lid 14, the lock assembly includes a slot 60, more in the nature of a single cut slit, defined in the fold line between the lid top panel 32 and the forward wall 36 thereof. This slit 62 is of a length corresponding to the maximum length of the tongue 54 for snug reception of the tongue therethrough.

Noting the blank of FIG. 13 in particular, it will be seen that the slit 62 includes a central peaked portion 64 inwardly directed relative to the top panel 32 whereby, upon a folding of the front lid wall 36 to its assembled position, a similarly peaked portion 66 will be folded out of the top panel 32 of the lid to extend upwardly therefrom, coplanar with the front wall 36 to lie immediately forward of the inserted tongue 54. The removal of this peaked portion from the top panel 32 will provide a triangular opening 68 in the top panel 32 extending inwardly from the forward edge thereof with the forwardly diverging side edges of this opening 68 engaging the opposed angled side edge portions 58 of the tongue 54 as the lid 14 is closed over the tray 12. This in turn ensures that the tongue will slide forwardly, a movement also enhanced by the inherent outward biasing of the tray front wall 20, to align with and engaged through the linearly aligned opposed end portions of the slit 62 beyond both sides of the peaked portion 64 thereof. Once the tongue 54 is extended completely through the slit 62, and particularly the linearly aligned end portions thereof, the tongue is locked into position and at least partially protected by the upward extension 66 extending from the upper edge of the lid front wall 36.

In order to facilitate release of the lock assembly and an opening of the lid utilizing only one hand, the front wall 36 of the lid 14 includes a central recess 70 therein extending upward from the free lower edge of this forward wall 36. Thus, and noting FIG. 12, when the lid 14 is to be released, a finger is engaged within the recess 70 while the thumb of the same hand engages the apex 60 of the tongue 54, and upwardly slides the forward wall 36 of the lid 14 while the tongue and tray are retained against the table or counter surface. This movement releases the tongue 54 from the opposed linear extensions of the slit 62, after which the tongue, possibly utilizing a portion of the opening 68, is completely released and the lid 14 free to upwardly swing away from the tray 12. It is preferred that the height of the vertical extension of the tongue 54 above the lid forward wall projection 66 be equal to or fractionally greater than the height of the tongue side edge portions 56 whereby upon a relative movement between the tongue 54 and forward wall projection 66 into alignment of the peaked portions thereof, the side edge portions 56 will be moved slightly below the linearly aligned end portions of the slit 62 for a freeing of the tongue 54 therefrom.

The actual engagement of a finger with the lid forward wall 36 as in FIG. 12, will also tend to inwardly flex the forward tray wall 20 of the tray and move the tapered upward portion of the tongue 54 toward the top panel recess 68 to encourage the releasing action.

With specific reference to the blank of FIG. 13, it will be seen that the recess 70 in the front wall 36 of the lid is dimensionally the same as the tongue 54 projecting from the forward wall 20 of the tray. Thus, the tongue and the recess can be formed by a single cut line between longitudinally adjacent blanks from an appropriate sheet of paperboard material, to simplify and expedite manufacture and reducing waste. As a similar expedient in reducing waste and the normally difficult task of removing internally formed waste, ventilating apertures 72 can be formed in the rear wall 18 by semi-circular lugs 74 formed in the opposed ends thereof and rigid with the corresponding glue flaps 38 whereby upon a folding of the glue flaps 38 at the opposed ends of the rear wall 18, the lugs 74 will pivot rearwardly relative to the rear wall and define the desired ventilation openings 72. This relationship will be best recognized from FIGS. 9 and 13.

While the lid 14 of the second embodiment is preformed with the side walls glued and extended, it is contemplated that the carton of this embodiment, for shipping and storing purposes, be folded substantially flat. Pursuant thereto, the opposed lid side walls 34 are provided with fold lines 76 which parallel the angled inner edges of the secured glue flaps 38 and extend for the full height of these side walls 34. The fold lines for each wall 34 converge downward toward the free lower edge thereof and allow for an inward collapsing of the side walls 34 against the overlying lid top panel 32 to produce a simultaneous inward folding of the rear and forward walls 18 and 36, as suggested in FIG. 14. As desired, the forward and side walls of the tray can also be inwardly folded, thus providing a substantially flat package which in turn allows for substantial economies in packaging and shipping.

The features and advantages of this embodiment with regard to the frictional biased engagement of the tray walls against the inner surfaces of the lid walls, and the open nature of the tray both in positioning a pizza or the like therein and in removing the food for consumption upon an opening of the carton, are the same as those discussed above with regard to the first embodiment.

The foregoing is considered illustrative of the features of the invention, and the invention is not to be limited to the two disclosed embodiments which are presented to set forth the features of the invention. Rather, the invention is to be only limited by the scope of the claims following hereinafter.

I claim:

1. A folded paperboard fast food carton comprising a tray and a lid integral therewith; said tray including a bottom panel having a periphery, adjacent peripheral walls encircling said periphery with each wall having an inner edge integral with said bottom panel at said periphery, and an outer edge, said peripheral walls comprising a rear wall with an integral hinge-forming fold line defined along the inner edge thereof, a forward wall and at least one intermediate wall, said forward and intermediate walls being foldable relative to said bottom panel along the inner edges thereof, said forward and intermediate walls each having opposed ends free of corresponding ends of adjacent ones of the walls; said lid including a top panel having a periphery generally coextensive with the periphery of the bottom panel, the outer edge of said rear wall being integral with the periphery of said top panel, said lid including adjacent forward and intermediate walls substantially coextensive with the corresponding forward and intermediate walls of said tray, said rear wall and said forward and intermediate walls of said lid each having opposed ends immediately adjoining and joined to corresponding ends of adjacent ones of the lid walls to define a fixed peripheral wall structure on said lid, said lid having a first open position pivotally removed from said tray, and a second closed position overlying said tray and enclosing said tray forward and intermediate walls, said tray forward and intermediate walls being outwardly biased relative to said tray bottom panel and engagable respectfully against the forward and intermediate walls of said lid in said second position for inward retention by said lid walls.

2. The carton of claim 1 including a lock assembly on said tray forward wall and said lid, said lock assembly automatically engaging upon a movement of said lid to said second position for locking said lid to said tray.

3. The carton of claim 2 wherein said lock assembly includes a tongue integral with said tray forward wall and extending outward relative thereto, and a tongue-receiving slot defined in said lid and receiving said tongue outwardly therethrough in said closed position of said lid over said tray, said lid including access means defined therein for facilitating manual access to said tongue for release thereof from said slot.

4. The carton of claim 3 wherein said slot is defined in the forward wall of said lid immediately adjacent said lid top panel, said tongue projecting forwardly from the forward wall of said tray adjacent the upper edge thereof for forward extension through said slot under the biasing action of said forward wall, said access means including an opening defined through said top panel directly communicating with and immediately inward of said slot.

5. The carton of claim 4 wherein said access means further includes an access opening defined in said lid forward wall communicating with and immediately below said slot whereby said tongue is exposed both above and below said slot.

6. The carton of claim 3 wherein said tongue extends upwardly from said outer edge of the forward wall of said tray coplanar therewith, said slot being defined through said lid at the juncture between the top panel and the forward wall of said lid for vertical reception of said tongue therethrough, said access means comprising an opening defined in the forward wall of said lid vertically spaced below said tongue-receiving slot and in alignment therewith for manual engagement of a finger within said access opening in conjunction with a finger engagement of said tongue for relative separating movement of said lid relative to said tongue.

7. The carton of claim 6 wherein said lid walls, in the close position of said lid, extend the full height of said tray and completely enclose said tray forward and intermediate walls.

8. The carton of claim 7 wherein said tray and said lid are of a substantially rectangular configuration with said rear wall and said forward wall of each said tray and lid being in spaced parallel relation to each other, and with two of said intermediate walls defining a pair of laterally spaced parallel side walls in each said tray and said lid, said rear wall and said lid walls flaring outward relative to each other from said top panel to define, in the closed position of the lid, the shape of a truncated pyramid.

9. The carton of claim 8 wherein said side walls of said lid each include a pair of fold lines extending from said top panel at opposed corners defined by said lid side wall with said rear wall and said lid forward wall, said fold lines converging toward the outer edge of the respective lid side wall wherein each lid side wall is laterally inwardly foldable between said fold lines with said tray rear wall and said lid forward wall inwardly drawn therewith for a collapsing of said lid.

10. The carton of claim 3 wherein said lid walls, in the close position of said lid, extend the full height of said tray and completely enclose said tray forward and intermediate walls.

11. The carton of claim 10 wherein said tray and said lid are of a substantially rectangular configuration with said rear wall and said forward wall of each said tray and lid being in spaced parallel relation to each other, and with two of said intermediate walls defining a pair of laterally spaced parallel side walls in each said tray and said lid, said rear wall and said lid walls flaring outward relative to each other from said top panel to define, in the closed position of the lid, the shape of a truncated pyramid.

12. The carton of claim 11 wherein said side walls of said lid each include a pair of fold lines extending from said top panel at opposed corners defined by said lid side wall with said rear wall and said lid forward wall, said fold lines converging toward the outer edge of the respective lid side wall wherein each lid side wall is laterally inwardly foldable between said fold lines with said tray rear wall and said lid forward wall inwardly drawn therewith for a collapsing of said lid.

13. A folded paperboard carton for fast food comprising a tray having opposed rear and forward walls and opposed side walls extending therebetween, a lid integral with said rear wall and including a top panel, and a forward lid wall and opposed side lid walls substantially coextensive with the corresponding tray walls and received immediately outward thereof upon a closing of said lid over said tray, said tray forward wall having an outer edge with an integral rearwardly directed flange therealong and a forwardly extending tongue coplanar with said flange, said lid forward wall having a tongue-receiving slot defined therethrough for receiving said forwardly extending tongue upon a closure of the lid over said tray, said tray forward wall having a forward bias thereto for positive engagement of said tongue through said slot, and an access opening in said lid top panel directly communicating with said slot and extending therefrom allowing manual retraction of said tongue inwardly beyond said lid forward wall.

14. The carton of claim 13 including a second access opening defined in said lid forward wall immediately below and in communication with said slot for inward passage of a tongue-manipulating finger inwardly beyond said lid forward wall.

15. A folded paperboard carton for fast food including a tray comprising a bottom panel, spaced parallel rear and forward walls and spaced parallel side walls between said rear and forward walls, and a lid integrally joined to said tray rear wall and selectively closeable over said tray, said lid including a top panel, a forward wall parallel to said tray rear wall, and opposed parallel side walls between said tray rear wall and said lid forward wall, said tray forward wall having a free upper edge with a locking tongue centrally thereof and upwardly projecting relative thereto and coplanar therewith, said lid having a tongue-receiving slot defined therethrough at a juncture between said top panel and said lid forward wall, and a finger access opening defined in said lid forward wall in alignment with and vertically spaced below said slot, wherein opening of the lid from a closed position over the tray is effected by engaging a first finger within said access opening and a second finger with the tongue above said slot and effecting a respective downward movement of said tongue and upward movement of said lid for retraction of said tongue from said slot, and a tongue-guiding opening defined in said top panel in communication with and inward of said slot.

16. The carton of claim 15 including a projection integrally formed with said lid front wall immediately adjacent said slot and projecting coplanar with said lid front wall above said top panel, said tongue engaging through said slot immediately inward of said projection wherein said projection stabilizes said tongue.

* * * * *